US005923921A

United States Patent [19]

OuYang et al.

[11] Patent Number: 5,923,921

[45] Date of Patent: Jul. 13, 1999

[54] VARIABLE TRANSFER ASSIST BLADE FORCE

[75] Inventors: William M. OuYang, Rochester; David P. Cropek, Walworth; Donald L. Miller, Penfield; Stephanie P. Burton; Julie A. Lapp, both of Rochester; Eugene L. Smith, Fairport, all of N.Y.

[73] Assignee: Xerox Corporation, Stamford, Conn.

[21] Appl. No.: 09/110,638

[22] Filed: Jul. 6, 1998

Related U.S. Application Data

[63] Continuation-in-part of application No. 08/869,451, Jun. 5, 1997, abandoned.

[51] Int. Cl.[6] ..... G03G 15/16

[52] U.S. Cl. ..... 399/66; 399/45; 399/81; 399/317; 399/318

[58] Field of Search ..... 399/317, 316, 399/297, 296, 45, 66, 81, 121, 389, 364, 318

[56] References Cited

U.S. PATENT DOCUMENTS

| | | | |
|---|---|---|---|
| 4,782,363 | 11/1988 | Britt et al. | 399/364 |
| 4,828,645 | 5/1989 | Van Bortel | 156/384 |
| 4,947,214 | 8/1990 | Baxendell et al. | 399/316 |
| 5,300,993 | 4/1994 | Vetromile | 399/339 |
| 5,300,994 | 4/1994 | Gross et al. | 399/339 |
| 5,321,477 | 6/1994 | Nagata et al. | 399/312 |
| 5,519,478 | 5/1996 | Malachowski | 399/45 X |
| 5,539,508 | 7/1996 | Piotrowski et al. | 399/170 |
| 5,568,238 | 10/1996 | Osbourne et al. | 399/311 |
| 5,678,122 | 10/1997 | Gross | 399/16 |
| 5,708,938 | 1/1998 | Takeuchi et al. | 399/250 |
| 5,717,977 | 2/1998 | Suzuki et al. | 399/45 |
| 5,805,957 | 9/1998 | Kodama et al. | 399/66 |

*Primary Examiner*—Arthur T. Grimley
*Assistant Examiner*—Sophia S. Chen
*Attorney, Agent, or Firm*—John M. Kelly

[57] ABSTRACT

An apparatus for mechanically assisting the transfer of an image from an image bearing member onto a substrate. The apparatus includes a transfer assist blade that forces a substrate toward an image bearing member, a motor, a mechanical assembly for coupling the motor to the transfer assist blade such that motor operation changes the transfer assist blade force, and a controller that controls the motor operation. The controller might receive inputs from a substrate sensor, an operator control panel, and/or a service adjustment. The controller might use those inputs to control the motor operation, and thus the transfer force. Alternatively, the controller might control the transfer force as a result of the operation of the overall machine, such as by changing the transfer force during duplex printing or during the transfer of various color images.

14 Claims, 4 Drawing Sheets

VARIABLE TRANSFER ASSIST BLADE FORCE

CROSS REFERENCE TO RELATED APPLICATION

This is a continuation-in-part of "Adjustable Transfer Assist Blade Force to Improve Image Transfer," filed by OuYang et al. on Jun. 5, 1997 and assigned application Ser. No. 08/869,451, abandoned.

FIELD OF THE INVENTION

This invention relates to electrophotographic marking machines. More particularly, it relates to a method and apparatus for varying the transfer force of a transfer assist blade.

BACKGROUND OF THE INVENTION

Electrophotographic marking is a well known and commonly used method of copying or printing documents. Electrophotographic marking is performed by exposing a substantially uniformly charged photoreceptor with a light image representation of a desired document. In response to that light image the photoreceptor discharges so as to create an electrostatic latent image of the desired document on the photoreceptor's surface. Toner particles are then deposited onto that latent image to form a toner image. That toner image is then transferred from the photoreceptor onto a copy substrate, such as a sheet of paper. The transferred toner image is then fused to the copy substrate, usually using heat and/or pressure. The surface of the photoreceptor is then cleaned of residual developing material and recharged in preparation for the production of another image.

The foregoing broadly describes a black and white electrophotographic printing machine. Electrophotographic marking can also produce color images by repeating the above process for each color of toner that is used to make the composite color image. For example, in one color marking process a charged photoreceptive surface is exposed to a light image which represents a first color, say black. The resulting electrostatic latent image is then developed to produce a black toner image which is then transferred onto a copy substrate. The photoreceptor is then recharged, re-exposed, and re-developed using a second color of toner, say yellow. That second color image is then transferred onto the copy substrate. The recharge, expose, develop, and transfer process is then repeated for a third color, say magenta, and finally for a fourth color, say cyan. The various color images are placed in superimposed registration such that a composite color image results. That composite color image is then fused onto the copy substrate.

The process of transferring charged toner particles from an image bearing member, such as a photoreceptor, onto a copy substrate involves overcoming the cohesive forces that hold toner particles to the image bearing member. One method of overcoming the cohesive forces involves the application of high intensity electrostatic fields in the transfer region. By controlling the electrostatic fields, the charged toner particles are transferred onto the copy substrate. Complicating the transfer process is the fact that the interface between the image bearing member and the copy substrate is seldom optimal. To improve that interface, mechanical devices that force the copy substrate into intimate and substantially uniform contact with the image bearing surface have been used. The mechanical devices frequently include a blade, referred to herein as a transfer blade, that pushes on the backside of the copy substrate. Typically, the blade force was provided by a spring or some other flexible component.

Unfortunately, prior art mechanical transfer assists have their problems. For example image deletions (caused by insufficient transfer of toner) all too frequently occur. Such image deletions are especially prevalent when duplex printing (marking on both sides of the copy substrate), when marking in color, and/or when the copy substrate changes, such as when papers of different weights are used as copy substrates. While some prior art mechanical transfer assists include electromechanical devices that change the force on the backside of the copy substrate, the force changes are crude and cannot be accurately controlled. Furthermore, prior art mechanical transfer assists are not operator adjustable. Finally, except for difficult to perform mechanical adjustments, prior art mechanical transfer assists do not provide service personnel with the ability to fine tune the operation of the mechanical transfer assist device.

Therefore, a method and apparatus for assisting transfer so as to reduce image deletions would be beneficial. Even more beneficial would be a method and apparatus for assisting transfer that is operator controlled, capable of being tuned by service personnel, and/or that automatically compensates for substrate types and weights.

The following disclosures may be relevant to various aspects of the present invention and may be briefly summarized as follows:

U.S. Pat. No. 5,568,238 to Osbourne et al. discloses an apparatus which transfers a developed image from a photoconductive surface to a copy sheet. The apparatus includes a corona generating device arranged to charge the copy sheet for establishing a transfer field that is effective to attract the developed image from the photoconductive surface to the copy sheet and a blade which is moved from a non-operative position spaced from the copy sheet, to an operative position, in contact with the copy sheet for pressing the copy sheet into contact with at least the developed image on the photoconductive surface to substantially eliminate any spaces between the copy sheet and the developed image during transfer of the developed imaged form the photoconductive surface to the copy sheet. The blade is fabricated to include a conductive material for preventing the generation of electrostatic charge on the blade which may create copy quality defects as a lead edge of the copy sheet passes between the blade and the photoconductive surface. A non-varying pressure is applied by the blade to the copy sheet regardless of the copy sheet stock or whether it is a simplex or duplex copy.

U.S. Pat. No. 5,539,508 to Piotrowski et al. discloses an apparatus for transferring a developed image from a photoconductive surface to a copy sheet. The apparatus includes a continuously variable length contact assembly which is moved from a nonoperative position spaced from the copy sheet, to an operative position, in contact with the copy sheet for pressing the copy sheet into contact with the developed image on the photoconductive surface to substantially eliminate any spaces between the copy sheet and the developed image during transfer of the developed image from the photoconductive surface to the copy sheet. The transfer apparatus is provided with a continuously variable length for selectively corresponding the length of the contact assembly with the process width dimension of the copy sheet.

U.S. Pat. No. 5,300,994 to Gross et al. discloses a transfer system including a contact member for applying pressure against a copy substrate to create uniform contact between the copy substrate and a developed image on an imaging member. The transfer system includes a flexible transfer assist blade and a rotatable cam shaft having a lobe for deflecting the transfer assist blade into contact with the copy substrate. Alternatively, the transfer assist blade may include multiple segments and the rotatable cam shaft may include a plurality of lobes, each having a length wise dimension corresponding to predetermined segments of the blade for providing contact across a dimension corresponding to that of the copy substrate. The system further includes a stepper motor for rotating the cam to predetermined angular positions to create an abutting relationship between the lobe and the transfer assist blade for deflecting selected segments of the blade toward the copy substrate. The transfer assist blade presses the copy sheet into contact with at least the developed image on the photoconductive surface to substantially eliminate any spaces or gaps between the copy sheet and the developed image during transfer of the developed image from the photoconductive surface to the copy sheet.

U.S. Pat. No. 5,300,993 to Vetromile discloses an apparatus which transfers a developed image from a photoconductive surface to a copy sheet. The apparatus includes a corona generating device arranged to charge the copy sheet for establishing a transfer field that is effective to attract the developed image from the photoconductive surface to the copy sheet and a blade which is moved from a non-operative position spaced from the copy sheet, to an operative position, in contact therewith. The blade presses the copy sheet into contact with at least the developed image on the photoconductive surface to substantially eliminate any spaces between the copy sheet and the developed image during transfer of the developed image from the photoconductive surface to the copy sheet.

U.S. Pat. No. 5,678,122 to Gross discloses a transfer system including an adjustable electromechanical operated pretransfer paper guide and a paper basis weight sensor. The pretransfer paper guide moves to a predetermined position to provide a proper bend to a substrate so as to flatten it out as the substrate reaches the transfer station. The position is changed so as to be optimal for both heavy as well as light weight substrates.

U.S. Pat. No. 4,947,214 to Baxendall et al. discloses a transfer assist blade that moves from a nonoperative position spaced from the substrate to an operative position that is in contact with the substrate. The blade presses the substrate into contact with the developed image on a photoreceptor to substantially eliminate any spaces between the substrate and the developed image.

SUMMARY OF INVENTION

The principles of the present invention provided for an apparatus that assists the transfer of an image from an image bearing member onto to a copy substrate. That apparatus includes a transfer blade that forces the copy substrate toward the image bearing member, a motor, a mechanical assembly for coupling the motor to the transfer assist blade such that motor operation changes the transfer blade force, and a controller that controls the motor operation. Beneficially the controller receives an input from a source, such as a substrate sensor or an operator control panel, and the controller uses that input to control the motor operation. Alternatively, it is beneficial if the controller controls the motor operation as a result of the operation of the overall machine, such as by changing the transfer blade force during duplex printing or during the transfer of various color images.

BRIEF DESCRIPTION OF THE DRAWINGS

Other features of the present invention will become apparent as the following description proceeds and upon reference to the drawings, in which.

DETAILED DESCRIPTION OF THE INVENTION

Figure 1:
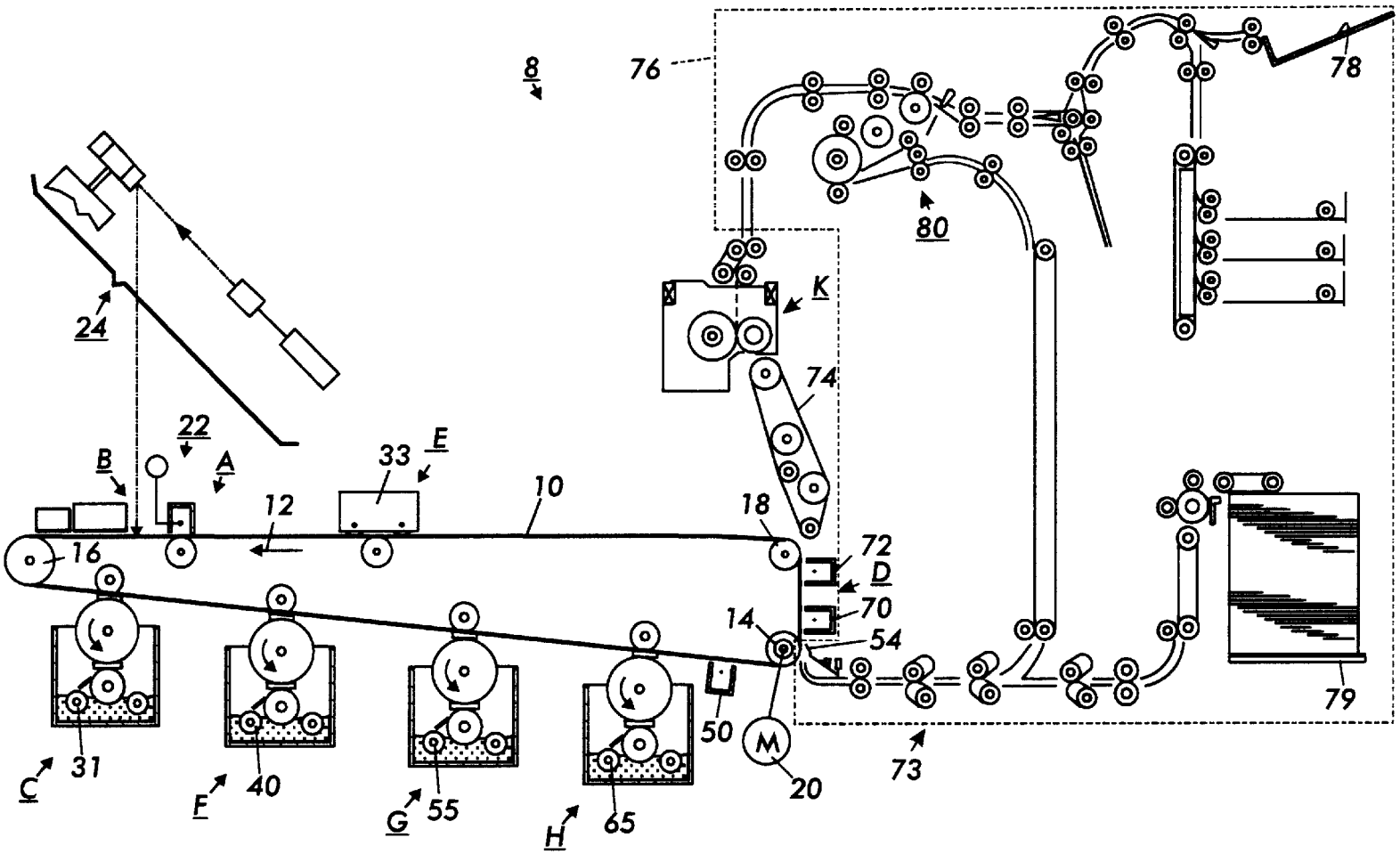
FIG. 1 is a schematic illustration of a printing apparatus according to the principles of the present invention.

To understand the principles of the present invention it is helpful to understand the operation of a color electrophotographic printer in some detail. Refer now to FIG. 1 for a schematic depiction of a color electrophotographic printing machine 8. That machine includes an Active Matrix (AMAT) photoreceptor belt 10 which travels in the direction indicated by the arrow 12. Belt travel is brought about by mounting the photoreceptor belt about a drive roller 14 and two tension rollers 16 and 18 and by rotating the drive roller 14 via a drive motor 20.

As the photoreceptor rotates each part of it passes through each of the subsequently described process stations. For convenience, a single section of the photoreceptor belt, referred to as an image area, is identified. The image area is that part of the photoreceptor which is to receive the toner images which, after being transferred and fused onto a substrate, produces the final image. While the photoreceptor may have numerous image areas, since each image area is processed in the same way a description of the typical processing of one image area suffices to fully explain the operation of the printing machine.

As the photoreceptor 10 moves, the image area passes through a charging station A. At charging station A a corona generating device, indicated generally by the reference numeral 22, charges the image area to a relatively high and substantially uniform potential, for example to about −500 volts. In practice, this is accomplished by charging the image area to slightly more negative than −500 volts so that any resulting dark decay reduces the voltage to the desired −500 volts. While the printing machine 8 uses a negatively charged image area, it should be understood that if the operating polarities of the other devices are appropriately changed the photoreceptor could be charged positively.

After passing through the charging station A the now charged image area passes through an exposure station B. At exposure station B, the charged image area is exposed to a light representation of a first color (say black) image. That light representation discharges some parts of the image area so as to create an electrostatic latent image. While the illustrated embodiment uses a laser based raster output scanning device 24 as a light source, it is to be understood that other light sources, for example an LED printbar, might be used. The voltage levels of the image area after exposure might be about −500 volts on those parts of the image area which were not illuminated and about −50 volts on the parts which were illuminated. Thus after exposure, the image area has a voltage profile comprised of relatively high and relatively low voltages.

After passing through the first exposure station B, the now exposed image area passes through a first development station C. The first development station C deposits a first color, say black, of negatively charged toner 31 onto the image area. That toner is attracted to the less negative sections of the image area and repelled by the more negative sections. The result is a first toner powder image on the image area. After development the undeveloped areas of the image area might have a potential of −500 volts while the developed toner might have a potential of −200 volts.

After passing through the first development station C, the now developed image area advances to a transfer station D. There, the toner particles are transferred from the photoreceptor onto a copy substrate. Since the present invention is directly related to the transfer of toner images from the photoreceptor onto a substrate, and since the principles of the present invention are better understood after the operation of more of the printing machine 8 is explained, the description of the operation of the transfer station will be described subsequently.

After the toner image is transferred onto a substrate the image area advances to a cleaning station E. There, any residual toner particles on image area are removed by a cleaner 33. The image area is then ready to begin a new cycle. Charging station A again charges the image area to a relatively high and substantially uniform potential, again, say about −500 volts. The exposure station again exposes the photoreceptor, this time with a light representation of a second color image (say yellow) to create a second electrostatic latent image. The image area then advances to a second development station F. The second development station deposits yellow toner 40 onto the image area. For various reasons the deposited yellow toner might have a potential different than that of the black toner. For example, the yellow toner might have a potential of about −175 volts. This potential variation means that the transfer characteristics of the yellow toner are somewhat different than the transfer characteristics of the black toner.

After passing through the second development station F, the now developed image area advances to the transfer station D. There, the toner particles are transferred from the photoreceptor onto a copy substrate. The image area is then cleaned at the cleaning station E and another cycle begins. The image area is then charged once again by the charging station A, and the exposure station B exposes the charged image area with a light representation of a third color image (say magenta) so as to create a third electrostatic latent image. That latent image is then developed using a third color of toner 55 (magenta) contained in a third development station G. The magenta toner may have a potential that is somewhat different than either the black or the yellow toner. Thus, its transfer characteristics may be somewhat different than the transfer characteristics of the other toners.

After passing through the third recharging station the now developed image area advances to the transfer station D. Again, the toner particles are transferred from the photoreceptor onto a copy substrate. The image area is then cleaned at the cleaning station E and another cycle begins. The image area is then charged once again by the charging station A, and the exposure station B exposes the charged image area with a light representation of a fourth color image (say cyan) so as to create a fourth electrostatic latent image. That latent image is then developed using a fourth color of toner 65 (cyan) contained in a fourth development station H. The cyan toner may have a potential that is somewhat different than any of the other toners. Thus, its transfer characteristics may be somewhat different than the transfer characteristics of the other toners.

Now we will focus on the transfer process at the transfer station D. The toner particles on the image area are strongly attracted to the photoreceptor by electrostatic forces. To assist transfer, the charges on the toner particles and photoreceptor are beneficially reduced. Still referring to FIG. 1, a pretransfer corotron 50 delivers corona charges to the image area to ensure that the toner particles on the image area are at a suitable level for transfer. After passing the pretransfer corotron the image area advances past the drive roller 14 and a copy substrate 52 (see FIG. 2) is advanced by a document feeder 73 of a document handler 76 over the image area. A transfer blade 54 (see FIGS. 1 and 2) presses the copy substrate 52 into intimate contact with the toner on the image area. In prior art machines the transfer blade either exerts a constant force toward the photoreceptor, the transfer blade moves from a noncontacting position to a contacting position in which the transfer blade's force is constant, or the transfer blade's force is switched between a limited number of force levels. However, according to the principles of the present invention the transfer blade's force is highly adjustable.

Continuing with the description of the transfer process, and referring now to FIG. 1, with the copy substrate pressed into contact with the image area, a transfer corona device 70 sprays positive ions onto the backside of the copy substrate. This causes the negatively charged toner particles to attach to the copy substrate. After passing the transfer corona device 70 the substrate passes a detack corona 72 which facilitates the separation of the copy substrate from the photoreceptor 10.

After transfer, the copy substrate moves onto a conveyor 74 which advances that copy substrate to a fusing station K. The fusing station K includes a fuser assembly which permanently affixes the transferred powder image to the copy substrate. Preferably, the fusing station K includes a heated fuser roller and a backup or pressure roller. When the copy substrate passes between the fuser roller and the backup roller the toner is permanently affixed to the copy substrate. After fusing, the copy substrate advances through the document handler 76. Depending upon the print task being performed, the copy substrate might be guided into an output chute 78 for removal by an operator. Alternatively, the copy substrate might pass into a document inverter 80 that inverts the document and returns the document back into the document feeder 73. The inverted copy substrate can then have an image transferred onto and fused with a second side of the copy substrate. This inversion, reinsertion, and remarking is referred to as duplex printing.

In color copying, the fusing station K can also operate such that the toner on the copy substrate is not fused to the substrate. In that case, the copy substrate with its unfused toner is passed directly through the document handler 76. The document inverter 80 then returns the copy substrate without inversion back into the document feeder 73. The noninverted document, which has at least one toner image, is then advanced by the document feeder over the image area such that the toner on the copy substrate is registered with the toner on the image area. The toner on the image area is then transferred onto the copy substrate as previously described. After transferring four colors of toner onto a copy substrate, the toner on the copy substrate is fused onto the copy substrate and a composite color image is produced.

It should be understood that the copy substrate 52, which may be any of a wide variety of sizes, types, and orientations is brought forward from a paper tray 79, which is also part of the document handler. It should also be understood that the various machine functions are regulated by an electronic subsystem (ESS) controller 200 (shown in FIG. 4). That controller preferably includes a programmable microprocessor that is capable of managing all of the machine functions according to a software program. Among other things, the controller 200 tracks whether the printing task being performed is duplex printing and/or color printing. Furthermore, the controller controls the operation of the transfer blade so as to vary the force that the transfer blade presses against the photoreceptor.

Figure 2:
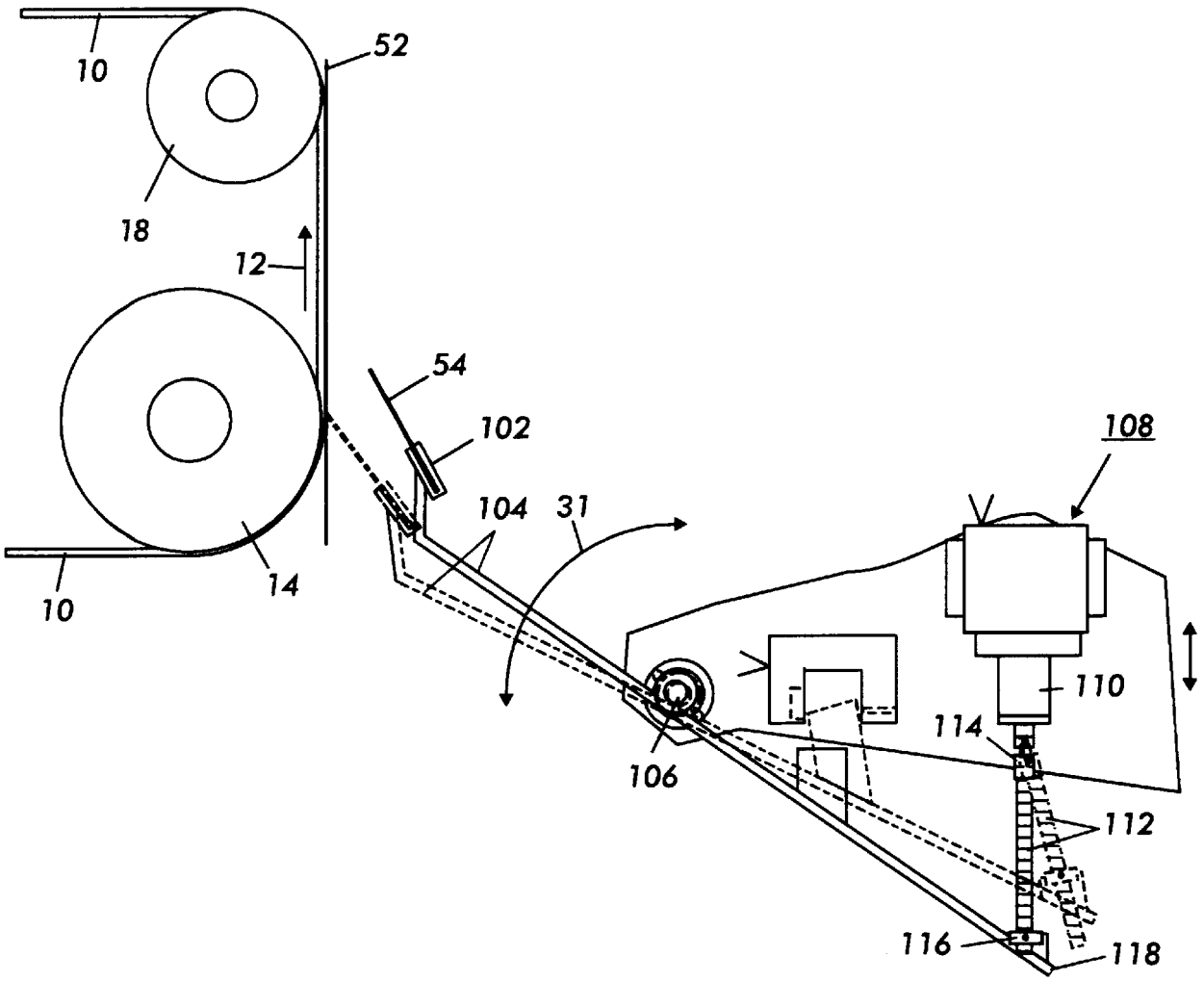
FIG. 2 is a schematic illustration of the operation of the transfer blade in FIG. 1.

Reference is now made to FIG. 2 for a schematic depiction of a transfer blade assembly. The transfer blade assembly includes the transfer blade 54 that presses the copy substrate 52 into intimate contact with the toner on the image area of the photoreceptor 10. The transfer blade is beneficially comprised of an approximately 3 to 5 mil thickness of a non-conductive material. That blade is removably secured to a blade holder 102 on a lever arm 104. According to the principles of the present invention the transfer blade force varies to prevent deletions without undue wear of the photoreceptor or the binding of the moving parts.

With continuing reference to FIG. 2, the transfer blade 54 is moved into and out of contact with the copy substrate 52 by pivoting the lever arm 104 about a pivot 106. Movement is accomplished using a bidirectional stepper motor 108. The stepper motor's shaft 110 attaches to a threaded rod 112 via a coupling 114. The threaded rod is screwed into a captured nut 116 near the end 118 of the lever arm. As the stepper motor turns the threaded rod rotates within the nut 116. This moves the end 118 of the lever rod, which pivots the lever arm about the pivot 106, resulting in the motion of the transfer blade 54. By rotating the stepper motor the transfer blade can be removed from contact with the copy substrate, or into contact with the copy substrate. Furthermore, the rotation of the stepper motor can vary the force of the transfer blade on the copy substrate. Beneficially, the transfer blade's force is directed toward a roller 14.

Figure 3:
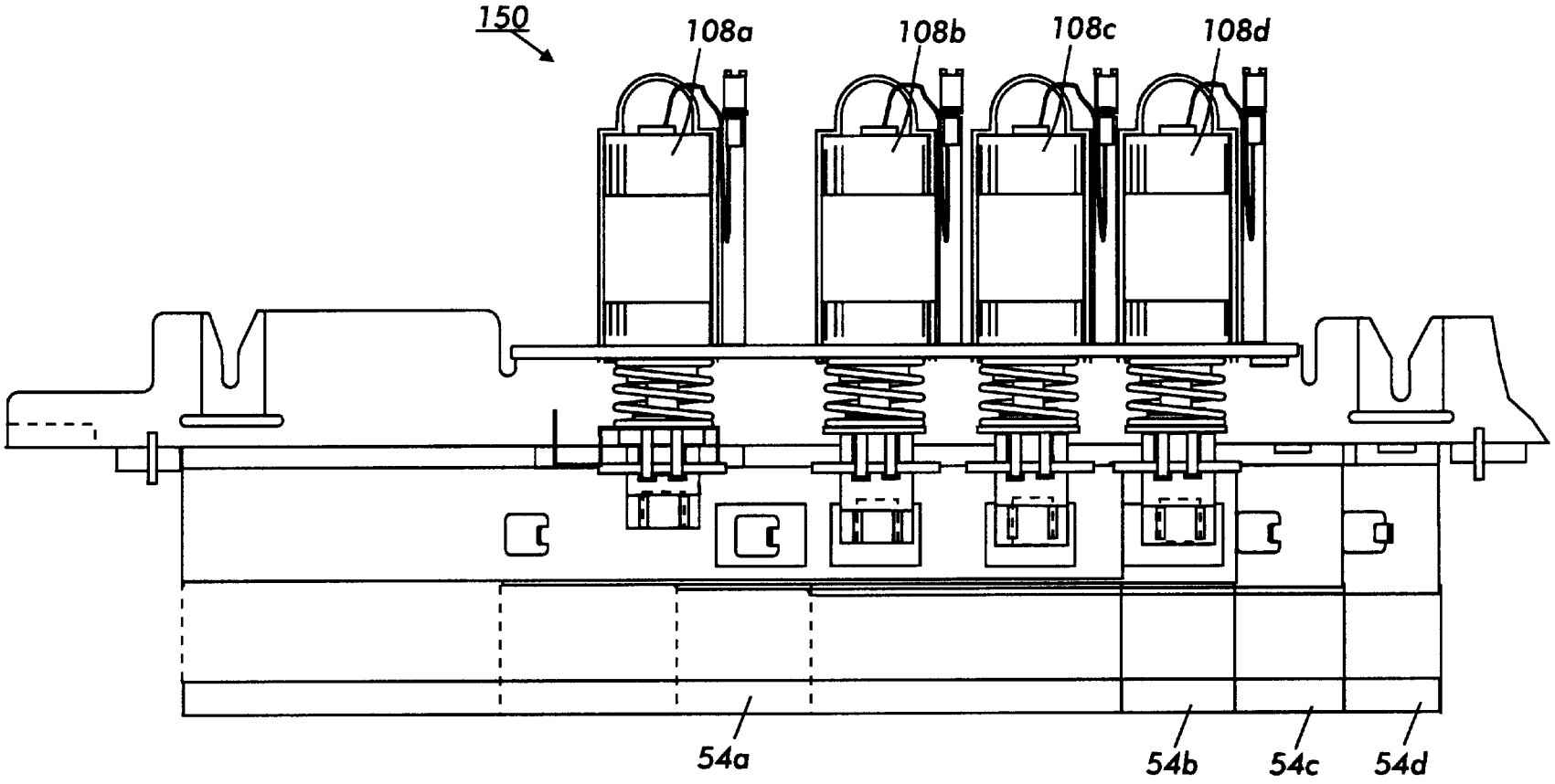
FIG. 3 is a plan view illustrating the transfer assist blade and stepper motor actuation mechanism.

Transfer blade assemblies as shown in FIG. 2 can be "stacked" if needed. For example, FIG. 3 shows a transfer blade assembly 150 that might be used in machines capable of making output or prints on various sizes of copy sheets is shown. The transfer blade assembly includes a plurality of transfer blades, transfer blades 54*a*, 54*b*, 54*c*, and 54*d*. Each of those blades is controlled by a separate stepper motor. Shown in FIG. 3 are stepper motors 108*a*, 108*b*, 108*c*, and 108*d*. The operation of stepper motor 108*a* moves the transfer blade 54*a*, operation of the stepper motor 108*b* moves transfer blade sections 54*b*; and so on.

From the foregoing one can understand that operation of the stepper motor 108 changes the force that the transfer blade places on the copy substrate. Essentially that force can be continuously varied over a wide range. Since stepper motors 108 move in discrete increments the force is not continuous in an absolute sense. Rather, the stepper motor can vary the transfer force in such small increments that the difference in transfer force between steps is small.

Figure 4:
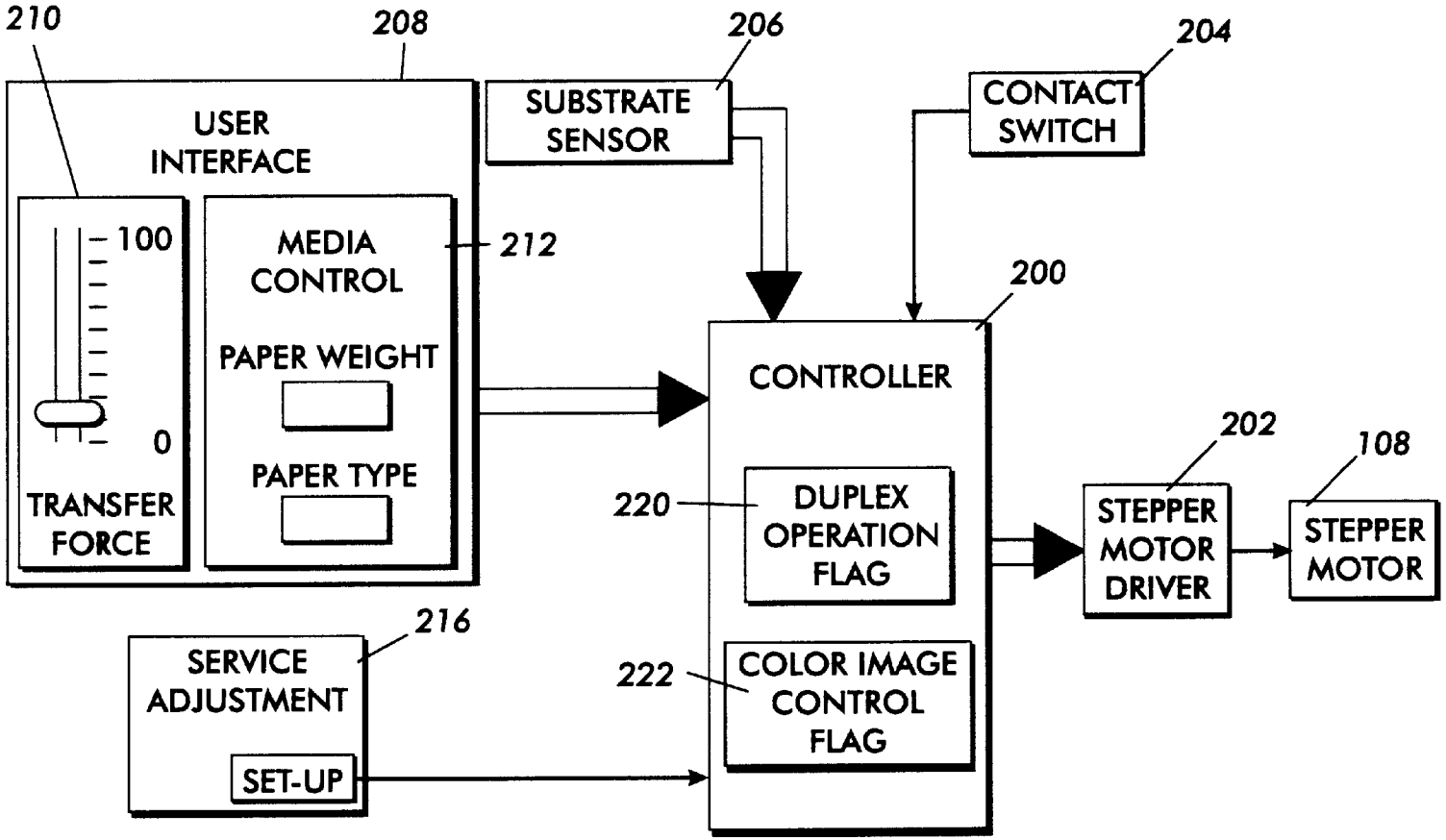
FIG. 4 is a schematic depiction of elements that control the operation of the stepper motor of FIG. 2.

Turn now to FIG. 4 for a description of how the controller 200 controls the stepper motor 108. By knowing when the transfer blade just contacts or just leaves contact with a copy substrate (or the photoreceptor) the controller can apply a direction control signal and a predetermined number of drive signals to a stepper motor driver 202 so as to cause the stepper motor 108 to move the transfer blade a predetermined distance from the photoreceptor 10, or to force the copy substrate toward the copy substrate with a predetermined force. For example, the controller 200 might have a look-up table of force verses stepper motor drive pulses, wherein the number of stepper motor drive pulses is taken relative to the initial contact of the transfer blade with a copy substrate. Therefore, it is important for the controller 200 to know when contact occurs. To that end the printing machine 8 includes a contact switch 204 that signals the controller 200 when the transfer blade contacts the copy substrate. By monitoring the state of the contact switch 204 the controller can determine when the transfer blade contacts or leaves contact with a copy substrate.

The printing machine 8 varies the transfer force as a result of the printing task being performed and as a result of several signal inputs. For example, the controller can vary the transfer force as required to improve duplex printing and/or color printing. When duplex printing it might be beneficial to force the copy substrate against the photoreceptor with greater force during the second pass of the copy substrate through the transfer process. This might allow compensation of the transfer process for any drying of the copy substrate after passing through the fusing process and/or for the toner layer already fused to one side of the copy substrate. Additionally, the controller might optimize the transfer process according to the particular color toners being used when printing in color and/or for the additional toner mass involved for the various color images. This tracking of the system operation is readily performed since the controller's software program directs the operations of the printing machine. To that end it is simple for the software program to include a duplex operation flag 220 or a color image control flag 222 that signals the controller how to control the transfer force.

The printing machine 8 also varies the transfer force as a function of the copy substrate itself. This is accomplished in two ways. First, the printing machine 8 includes a substrate sensor 206 the senses various parameters of the copy substrate, beneficially, weight, type, and surface roughness. The output of the substrate sensor is applied to the controller 200, which adjusts the transfer force to improve transfer. Additionally, the printing machine 8 includes a user interface 208 that allows an operator to input information to the controller 200 that overrides the information from the substrate sensor 206. For example, the user interface in the printing machine 8 includes a variable transfer force adjustment 210 that causes the transfer force to vary in a manner similar to how magnification levels and/or copy lighter or copy darker levels are implemented. This feature enables the customer to increase or decrease the transfer assist blade force setting to correct for deletions. Beneficially there could be a nominal force point, just as there is a nominal copy darker/lighter point and a nominal 100% magnification setting. Additionally, the user interface 208 includes a media control input 212 that enables an operator to input paper weight and copy substrate type information to the controller.

The copy substrate sensor 206 and the media control 212 are particularly useful. Currently in some printing or copying machines, the lighter pound stocks tend to cause more deletions than stiffer, heavier pound stock. Also, the type or quality of stock is a factor because often better quality paper has less deletions than lower quality paper. Ideally, the customer would provide the brand of print media (e.g. paper) and paper weight. Using a look up table or some other reference source, the controller's software would then use the that information to determine the optimal transfer force.

The printing machine 8 also includes a service adjustment 216 that enables a service person to set-up the printing machine. For example, a diagnostic mode might be implemented wherein a service person leaves the platen glass of a copier up while making copies. The resulting image on the copy substrate is called a dark dusting. Dark dustings can show service personnel where and if deletions (e.g. light areas) occur. Then, the service person can prepare a dark dusting and adjust the force of the transfer blade until the deletions disappear. The resulting setting can then be used by the printing machine as the nominal transfer force from which the controller varies the transfer force in response to the various other inputs and operations described above.

While the foregoing invention has been described in conjunction with a specific embodiment, it is evident that many alternatives, modifications, and variations will be apparent to those skilled in the art. Accordingly, the present invention it is intended to embrace all alternatives, modifications and variations that fall within the spirit and broad scope of the claims.

It is claimed:

1. An apparatus for assisting the transfer of an image from an image bearing member onto a copy substrate, comprising:

an image bearing member carrying an image;

a copy substrate having a first surface that overlays said image and a second surface opposite said first surface;

a motor;

a transfer assist mechanism operatively connected to said motor, said transfer assist mechanism including a lever arm having a holder, a threaded coupling operatively connected to said lever arm and to said motor, said coupling for moving said lever arm when said motor operates, and a transfer blade attached to said holder for pushing on said second surface with a force that varies according to the operation of said motor; and a controller for operating said motor in accordance with system information so as to adjust said force so as to reduce deletions in the transfer of said image onto said copy substrate.

2. An apparatus as recited in claim 1, wherein said system information includes information related to the weight of said copy substrate.

3. An apparatus as recited in claim 2, wherein said weight information is input by an operator.

4. An apparatus as recited in claim 2, wherein said weight information is input by a substrate sensor.

5. An apparatus as recited in claim 1, wherein said system information includes information related to the type of said copy substrate.

6. An apparatus as recited in claim 5, wherein said copy substrate type information is input by an operator.

7. An apparatus as recited in claim 5, wherein said copy substrate type information is input by a substrate sensor.

8. An apparatus as recited in claim 1, wherein said system information is from a user interface.

9. An apparatus as recited in claim 1, wherein said system information includes information from a contract switch.

10. An apparatus as recited in claim 1, wherein said system information includes information from a service adjustment.

11. An apparatus as recited in claim 1, wherein said system information includes information regarding color printing.

12. An apparatus as recited in claim 1, wherein said motor is a stepper motor.

13. An apparatus as recited in claim 1, further including a document inverter for inverting said copy substrate after transfer of said image onto said first surface and such that said second surface overlays a second image on said image bearing member, and wherein said system information includes information related to said second surface overlaying said second image.

14. An apparatus as recited in claim 13 wherein said image is fused onto said copy substrate prior to inversion by said document inverter.

* * * * *